US007707933B2

(12) United States Patent
Daivari

(10) Patent No.: US 7,707,933 B2
(45) Date of Patent: May 4, 2010

(54) GOLF BALL MARKER

(76) Inventor: Khosrow Daivari, 2324 Lyndale Ave. South, Minneapolis, MN (US) 55405

( * ) Notice: Subject to any disclaimer, the term of this patent is extended or adjusted under 35 U.S.C. 154(b) by 480 days.

(21) Appl. No.: 11/724,339

(22) Filed: Mar. 12, 2007

(65) Prior Publication Data

US 2007/0209536 A1 Sep. 13, 2007

Related U.S. Application Data

(60) Provisional application No. 60/781,494, filed on Mar. 11, 2006.

(51) Int. Cl.
*B41F 17/30* (2006.01)
*B41F 17/34* (2006.01)

(52) U.S. Cl. ..... 101/42; 101/40; 101/109; 101/405; 101/DIG. 40

(58) Field of Classification Search ..... 101/41, 101/42, DIG. 40
See application file for complete search history.

(56) References Cited

U.S. PATENT DOCUMENTS

| | | | | |
|---|---|---|---|---|
| 849,600 | A | 4/1907 | Cory | |
| 1,281,063 | A | 10/1918 | Pearson | |
| 1,286,206 | A | 12/1918 | Bates | |
| 1,641,562 | A | 9/1927 | Will et al. | |
| 1,740,630 | A * | 12/1929 | Smith, Jr. | 40/328 |
| 1,814,170 | A | 7/1931 | Long | |
| 2,561,947 | A | 7/1951 | Premo | |
| 4,086,851 | A * | 5/1978 | Brandell | 101/4 |
| 4,163,421 | A | 8/1979 | Sihota | |
| 5,743,180 | A | 4/1998 | Arnke | |
| 6,125,747 | A | 10/2000 | Elliott | |
| 6,379,271 | B1 | 4/2002 | Arnke | |
| 6,829,989 | B2 | 12/2004 | Chudy | |

FOREIGN PATENT DOCUMENTS

| | | | |
|---|---|---|---|
| JP | 02128845 A | * | 5/1990 |
| JP | 07089047 A | * | 4/1995 |

OTHER PUBLICATIONS

Innovative Stamp Website. http://www.innovativestamp.com/golf_ball_stamp.htm.
Izzo—Gold Eagle Practice Golf Balls Website. http://www.golfgods.com/short-flyte-practice-balls1.html.
G-Stamp Golf Ball Monogrammer: The Ultimate Golf Ball Monogrammer. http://www.gstamp.com, pp. 1-2.
Superior Rubber Stamp & Seal Inc.: OneStroke Golf Ball Stamp. http://superiorrubberstamp.com/Merchant2/merchant.mvc?Screen=CTGY&Store_Code=SRSSI &Category_Code=GOLF.

* cited by examiner

*Primary Examiner*—Daniel J Colilla
(74) *Attorney, Agent, or Firm*—Kinney & Lange, P.A.

(57) ABSTRACT

A golf ball stamper which securely holds a golf ball while the golf ball is stamped. The golf ball stamper comprises a handle, a stamping element coupled to the handle, and a golf ball receptacle sized to hold a golf ball. When the handle is pushed, the stamping element applies a stamp to the golf ball. The golf ball receptacle stabilizes and holds the golf ball while it is stamped to ensure a legible stamp is applied.

13 Claims, 6 Drawing Sheets

GOLF BALL MARKER

CROSS-REFERENCE TO RELATED APPLICATION(S)

This application claims priority from the provisional application No. 60/781,494, for "Golf Ball Stamp" by Khosrow Daivari filed Mar. 11, 2006, which is hereby incorporated by reference.

BACKGROUND OF THE INVENTION

A round of golf often involves several people playing the game together. Each person playing in a group plays with their own ball. Most golf balls are white, and are very similar in appearance, often varying only in the brand name stamped on the ball. Because golf balls look so similar, it is common for the players to get confused as to whose ball is whose. In some instances, more than one person uses the same brand of golf ball, making it even more difficult for the players to distinguish their golf balls.

To alleviate this problem, it is common for one or more players to mark their golf ball with a distinguishing mark to be able to tell it apart from the others. For instance, it is possible to simply carry a marker in ones golf bag and use it to mark the golf ball. Some markers are specifically available in a miniature size so that they are convenient to carry in a golf bag.

Other more sophisticated methods of marking golf balls also exist. For instance, the G-STAMP, sold by Golf Projects International, is a stamp system for marking a golf ball. The G-STAMP is complicated to use, and requires removal of a protective cap and release of a locking mechanism that keeps the stamp closed. In addition, the user must dial in a letter combination on the GSTAMP. Once the letters are set, the ink pad must be opened, and the GSTAMP must be pressed down a few times to put ink on the letters. Finally, a golf ball is inserted into the GSTAMP and the user presses the GSTAMP to stamp the golf ball. If not enough ink has been applied to the ink pad, the GSTAMP may not successfully mark the ball, and the user must remove the golf ball, reapply ink to the ink pad, prime the stamp mechanism by pressing down several times, and then try again to mark the golf ball. In addition to shortcomings due to the inking method, the device is large, which makes it inconvenient to carry around in a golf bag. Finally, it is relatively complicated to use.

Other golf ball stamping devices also exist. A smaller, simpler method of stamping a golf ball is to apply a simple stamp to the surface of a golf ball. An example of such a stamp system is the "One Stroke" golf ball stamp available from Superior Rubber Stamp & Seal, of Wichita, Kans. A similar device, simply called a "golf ball stamp" is available from Innovative Stamps of Moraga, Calif. While the "One Stroke" golf ball stamper requires that you apply ink to the stamp before applying the stamp to a golf ball, the "golf ball stamp" is self-inking.

Both devices suffer from the same shortcoming in attempting to mark a golf ball. Because the "One Stroke" golf ball stamper and the "golf ball stamp" have a small, flat stamp area, and because a golf ball has a curved surface, it is often difficult to hold the stamp surface against the golf ball in such a way as to apply a legible stamp to the golf ball. Instead, when applying the pressure to cause the stamp to mark a golf ball, the stamp will often slide across the curved surface of the golf ball, leaving a smeared mark. Thus, there is a need in the art for a golf ball stamp that is easy to use and that reliably applies a legible stamp to a golf ball.

BRIEF SUMMARY OF THE INVENTION

The present invention is a simple golf ball stamp having a handle, a location to receive a golf ball (the golf ball receptacle), and a stamp. A golf ball fits into the golf ball receptacle, and when the handle is pushed, the stamp places a mark on the golf ball. The golf ball is then ejected from the receptacle, bearing a unique mark. Because the stamp includes a golf ball receptacle for holding the golf ball, the stamper reliably applies a legible stamp to the golf ball every time.

DETAILED DESCRIPTION

Figure 1A:
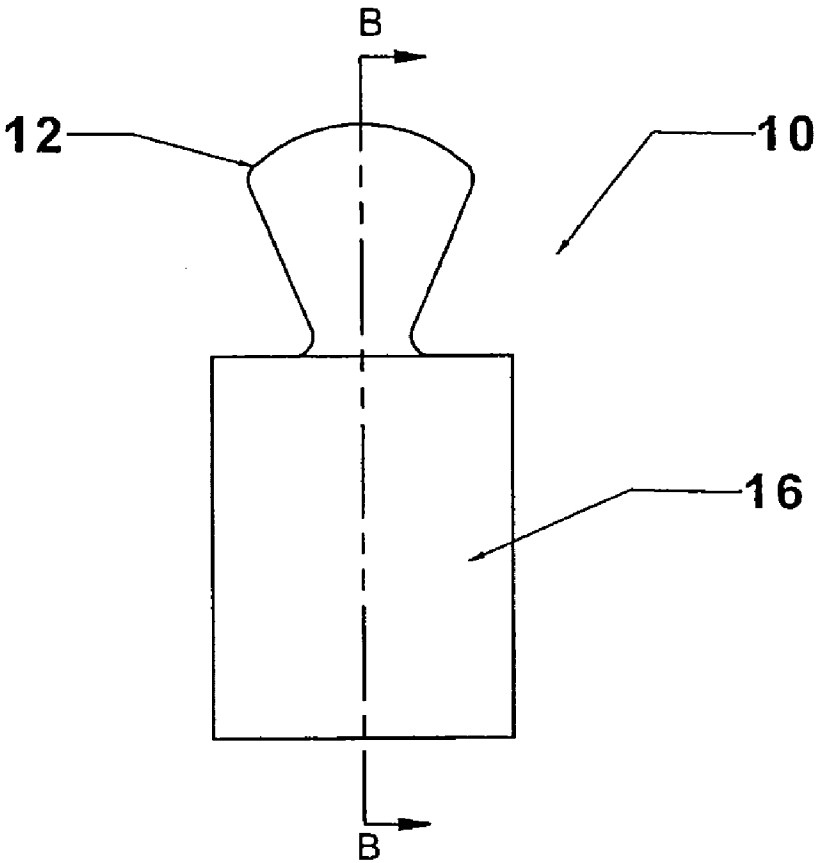
FIG. 1A is a side view of a golf ball stamper.
Figure 1B:
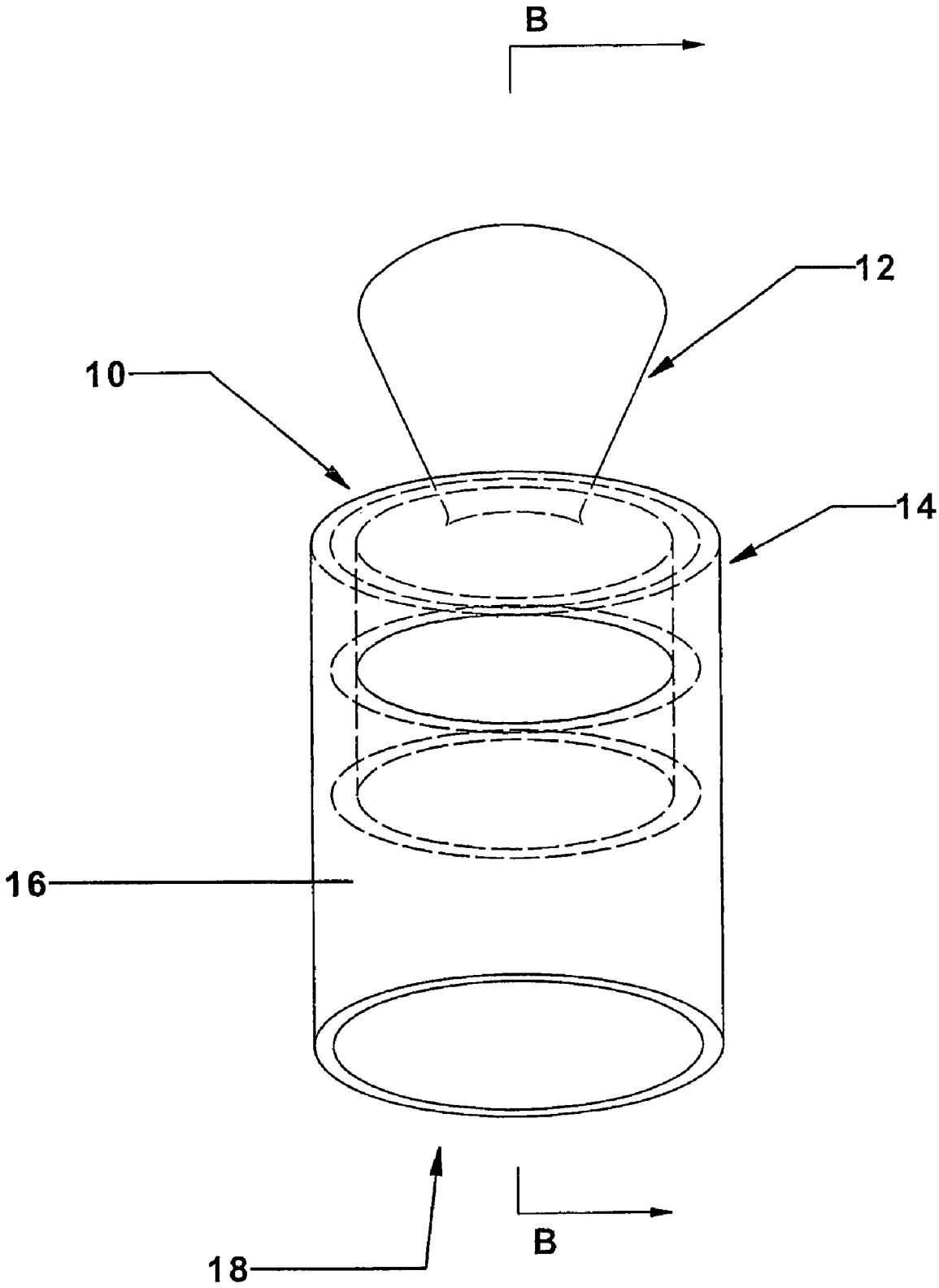
FIG. 1B is a perspective view of the golf ball stamper.

FIGS. 1A and 1B illustrate the golf ball stamper of the present invention. The golf ball stamper 10 comprises a handle 12, a stamp mechanism 14, and a golf ball receptacle 16. The golf ball receptacle 16 may take the form of a hollow cylinder, allowing a golf ball to be placed into an aperture 18 of the receptacle.

To use the golf ball stamper, a golf ball is placed into the aperture 18 of the golf ball receptacle 16 and the handle 12 is pushed. Pushing the handle 12 causes the stamp mechanism 14 to contact the golf ball and stamp a mark on the golf ball. The golf ball may be held in the receptacle 16 by placing the ball on a flat surface or by holding the bottom of the receptacle 16 in a person's palm. Because the golf ball fits snugly in the receptacle 16 while the stamp is applied, the stamp always contacts the surface of the golf ball in a reliable manner, resulting in a clear and legible mark on the golf ball. Once the ball has been stamped, the ball can be ejected from the receptacle 16 by gently shaking the golf ball stamper 10 or by tapping it to make the golf ball fall out of the receptacle 16.

Figure 2:
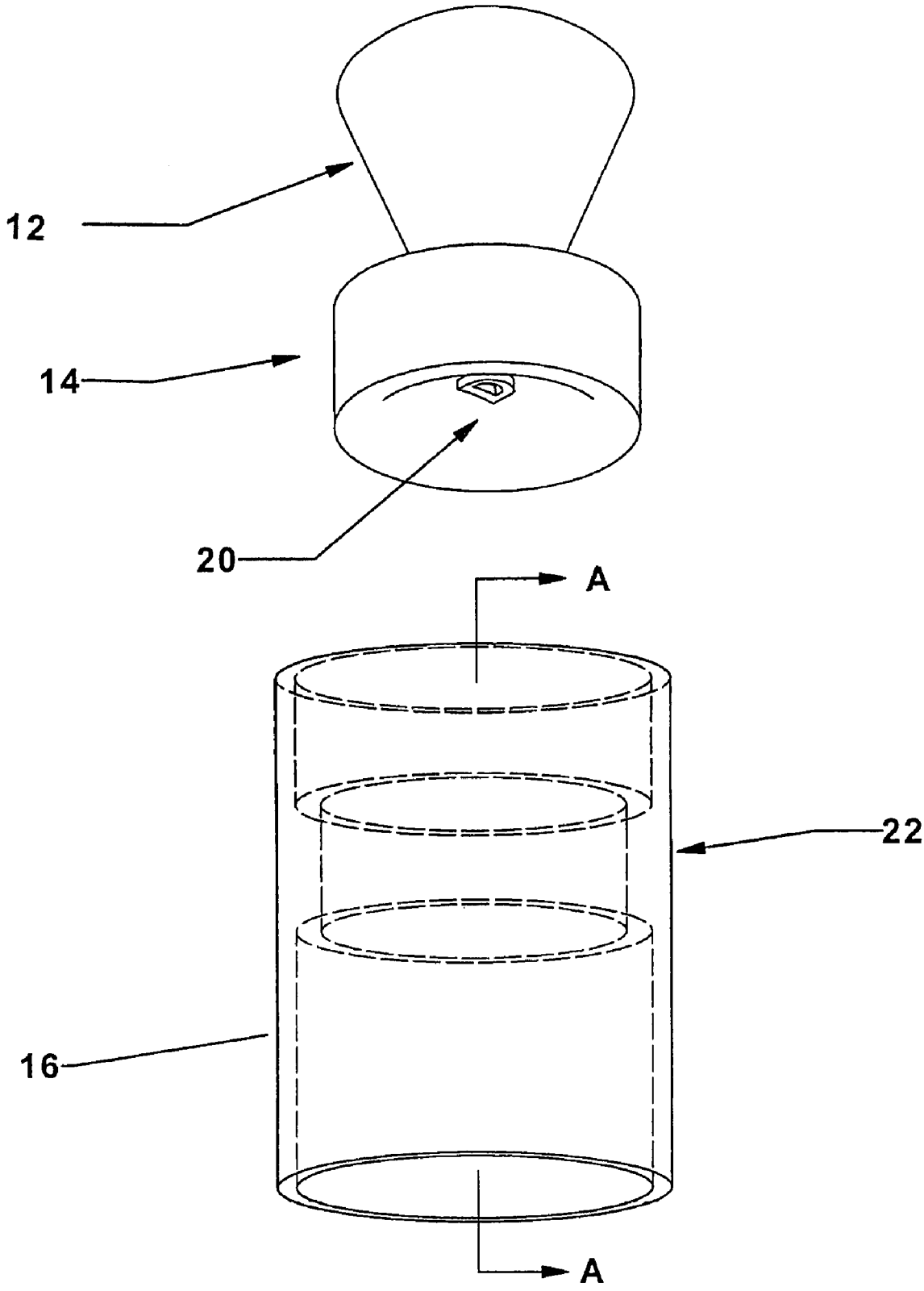
FIG. 2 is an exploded perspective view of the parts comprising the golf ball stamper.

FIG. 2 is an exploded view of the golf ball stamper. Shown once again is the handle 12 connected to the stamp element 14. The stamp element 14 comprises a stamp indicia 20 which contacts a golf ball to mark the golf ball. The golf ball receptacle 16 further comprises an inner ring 22. As described below, the inner ring 22 functions to hold the stamp element 14 in the receptacle 16, as well as providing a way to ensure the golf ball placed in the receptacle 16 is properly placed and held while the stamp mechanism is used.

Figure 3B:
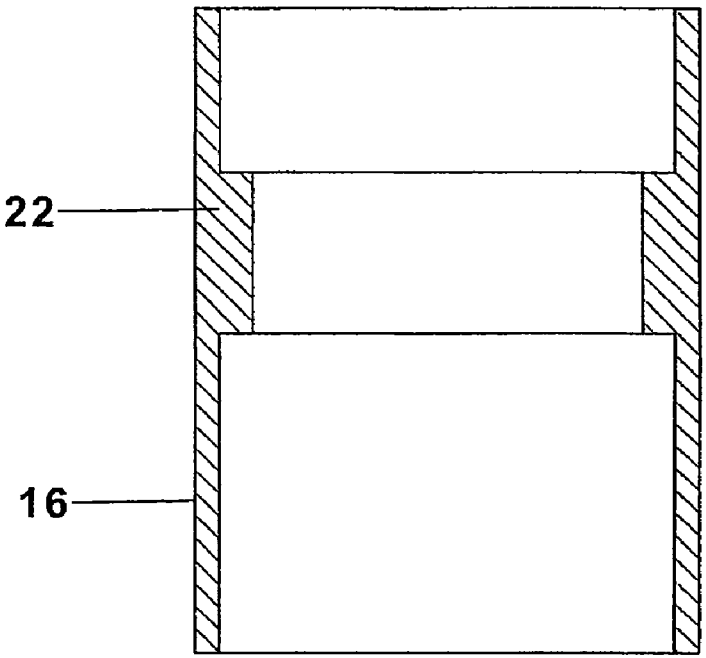
FIG. 3B is a cross sectional view of the golf ball receptacle.
Figure 3A:
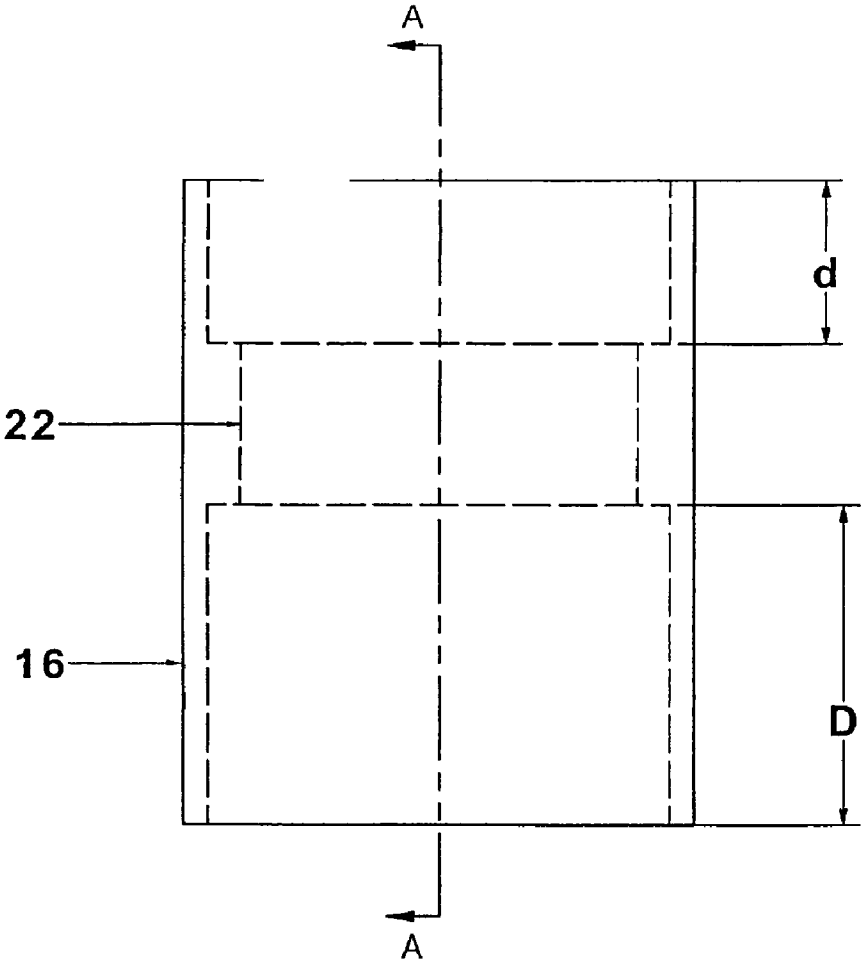
FIG. 3A is a side view of the golf ball receptacle of the golf ball stamper.

The inner ring 22 is shown more clearly in FIGS. 3A and 3B. FIG. 3A is a side view of the golf ball receptacle, while FIG. 3B is a cross sectional view of the golf ball receptacle 16 taken along line A-A of FIG. 2. The inner ring 22 is located a distance of d from the top of the receptacle 16 (as shown in FIG. 3A). The distance d provides a location in the receptacle 16 for insertion of a stamping mechanism. The stamping mechanism may be held in the receptacle 16 using any suitable method, and may either be permanently held in the receptacle, or may be releasably attached to the receptacle 16.

One benefit of making the stamping element releaseably attached to the receptacle 16 is to allow for the user to choose from various stamp designs when using the golf ball stamper. For instance, more than one stamping mechanism can be provided and the user can chose which stamp they feel like using on a particular day. Or, if more than one person playing the round wishes to mark their balls, it is easy to exchange the stamp mechanisms to allow for this.

The inner ring 22 is also located a distance D from the bottom of the receptacle. The distance D corresponds roughly to a diameter of a golf ball. Preferably, the golf ball is held in the receptacle 16 so that the golf ball is entirely enclosed in the receptacle 16. This ensures the golf ball stamp is applied in a way that reliably stamps the golf ball with a legible mark. Other smaller devices, which do not have a receptacle to hold the golf ball, often result in a smeared mark due to the stamp slipping across the curved surface of the golf ball when applying the stamp to the golf ball. Alternatively, the receptacle 16 may be sized so that the golf ball extends slightly out of the bottom of the receptacle 16. Any suitable size of receptacle that ensures the golf ball is held while the stamp is applied is suitable for the present invention.

The receptacle may further be equipped with a golf ball retaining structure to temporarily hold a golf ball in place in the receptacle while the stamp is applied. Any suitable retaining structure may be used, such as a thin flexible bumper to temporarily hold the golf ball in place.

Figure 4:
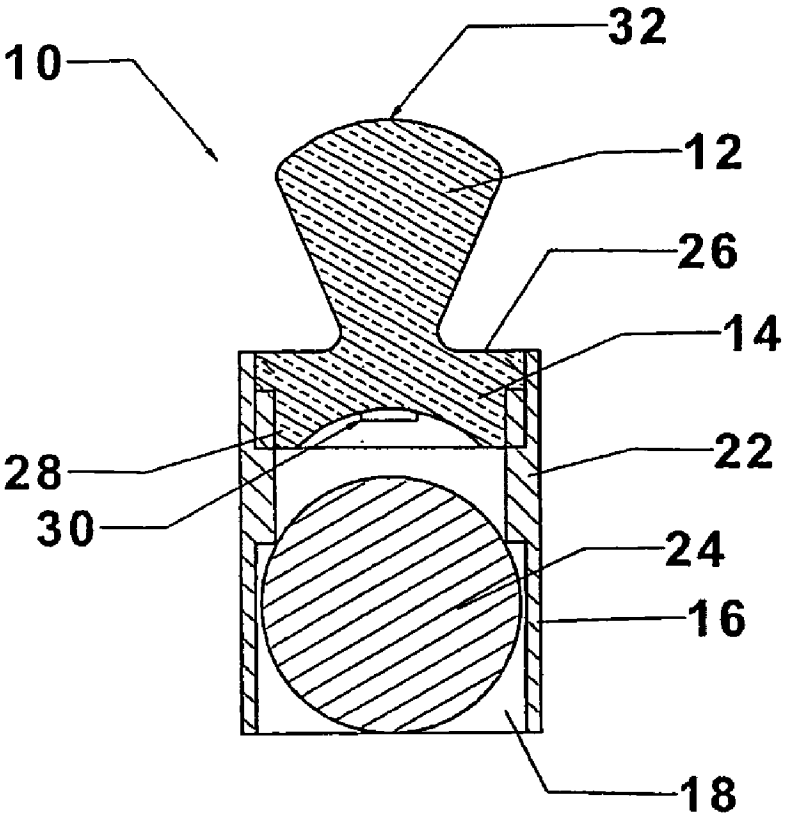
FIG. 4 is a cross sectional view of the golf ball stamper taken along line B-B of FIG. 1B.

FIG. 4 is a cross sectional view of the golf ball stamper taken along line B-B of FIG. 1A. Once again visible on the golf ball stamper is the golf ball receptacle 16, the inner ring 22, the stamp portion 14, and the handle 12. Also shown is a golf ball 24. As shown, the golf ball receptacle 16 has an inner diameter that corresponds closely with the diameter of the golf ball 24, so that the golf ball 24 fits inside the receptacle 16.

As can be seen more clearly in FIG. 4, the handle 12 is connected to the stamp mechanism 14. The stamp mechanism 14 comprises a stamp body 26, movable stamp portion 28, and stamp area 30. The stamp area 30 is carried on the movable stamp portion 28, and the movable stamp portion 28 is connected to the handle 12. The stamp body 26 is sized to fit inside the golf ball receptacle 16 and abut against the inner ring 22. The movable stamp portion 28 is connected to the handle 12, and is sized to be smaller in diameter than the inner ring 22 so that the movable stamp portion 28 can be moved toward the golf ball 24 as the handle 12 is depressed. Once fully depressed, the handle 12 causes the stamp area 30 to contact the golf ball 24.

Located on the handle 12 may be an indicia area 32. The indicia area 32 may be provided to indiciate the same design as the design indicia of the stamp. In this way, a user can easily view the handle 12 of the golf ball marker to determine what design will be applied to the golf ball.

To use the present invention, a golf ball is placed in the golf ball receptacle 16. The inner ring 22 ensures the golf ball 26 is positioned properly in the golf ball receptacle 16. More specifically, as shown in FIG. 4, the golf ball 24 contacts the lower edge of the inner ring 22 when the golf ball 24 is placed in the receptacle 16. Thus, the inner ring 22 assists in holding the golf ball 24 in the receptacle and helps stabilize the golf ball 24 as it is stamped.

Once inserted into the golf ball marker, a user places the golf ball marker on a surface or holds the receptacle in the palm of their hand. The golf ball receptacle 16 thus encloses the golf ball 24 and the ball 24 cannot fall out of the receptacle 16. While holding the bottom of the receptacle against a surface or the palm of the hand (with the golf ball 24 inside), the handle 12 is pressed. Pressing the handle 12 causes the movable stamp portion 28 to move toward the golf ball 24, while the stamp mechanism 14 is held snug as the stamp body 26 is prevented from moving by the top of the inner ring 22. Because the movable stamp portion 28 is smaller in diameter than the inner ring 22, the movable stamp portion 28 moves toward the golf ball surface. The movable stamp portion 28 contacts the golf ball 24 at the stamp area 30, leaving a stamped mark on the golf ball. Once marked, the golf ball marker is lifted off the golf ball, leaving the golf ball with its mark.

Alternately, the inner diameter of the golf ball receptacle may be slightly smaller than the diameter of a golf ball so that the golf ball fits snugly inside the receptacle, and is held inside the golf ball receptacle by the snug fit. The fit may be snug enough to hold the golf ball in the receptacle during the application of the stamp to the golf ball as well. After stamping the golf ball, the golf ball is removed from the receptacle by lightly shaking or tapping the golf ball marker to dislodge the golf ball from the receptacle.

Figure 5A:
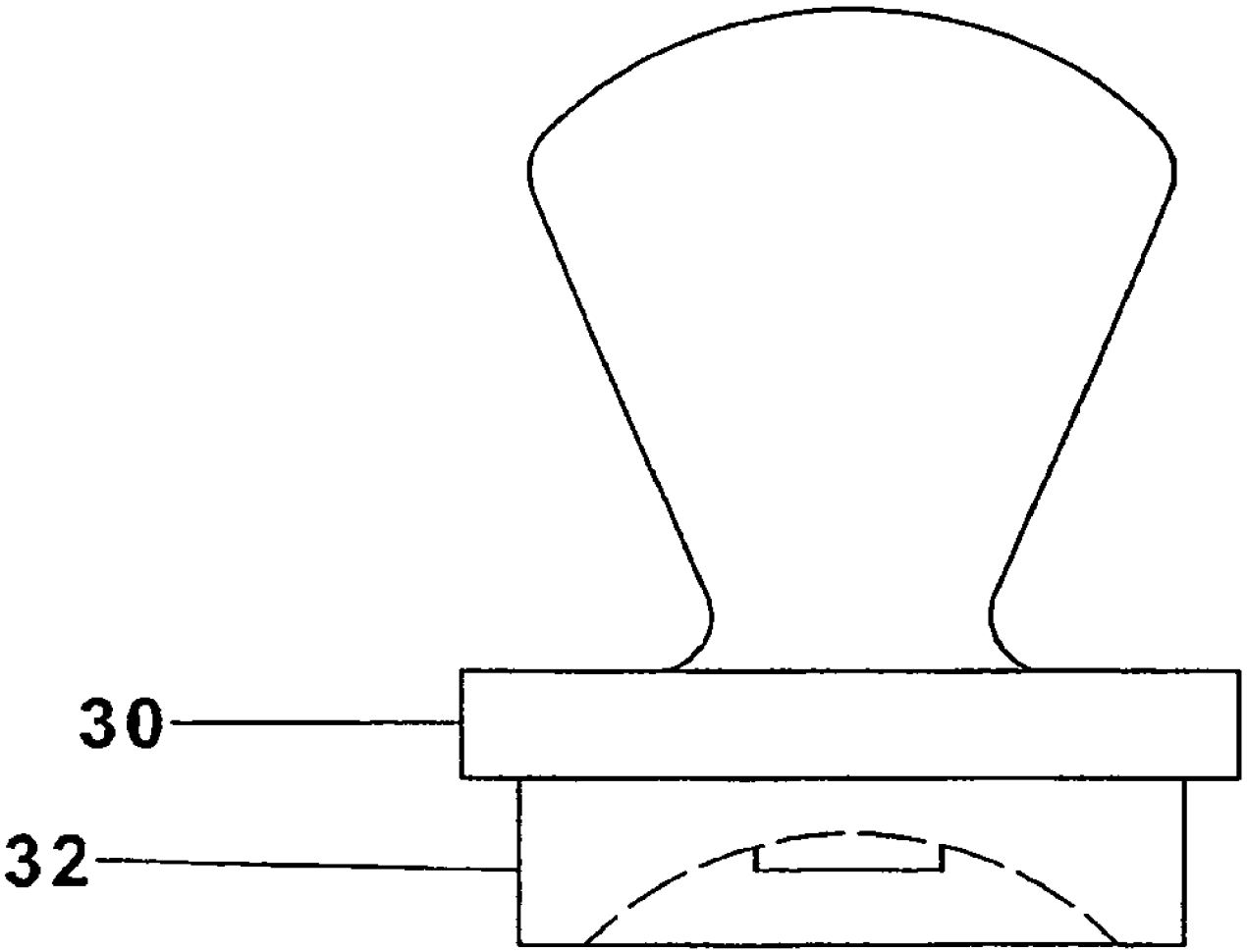
FIG. 5A is a side view of a stamp portion for use in the present invention.
Figure 5C:
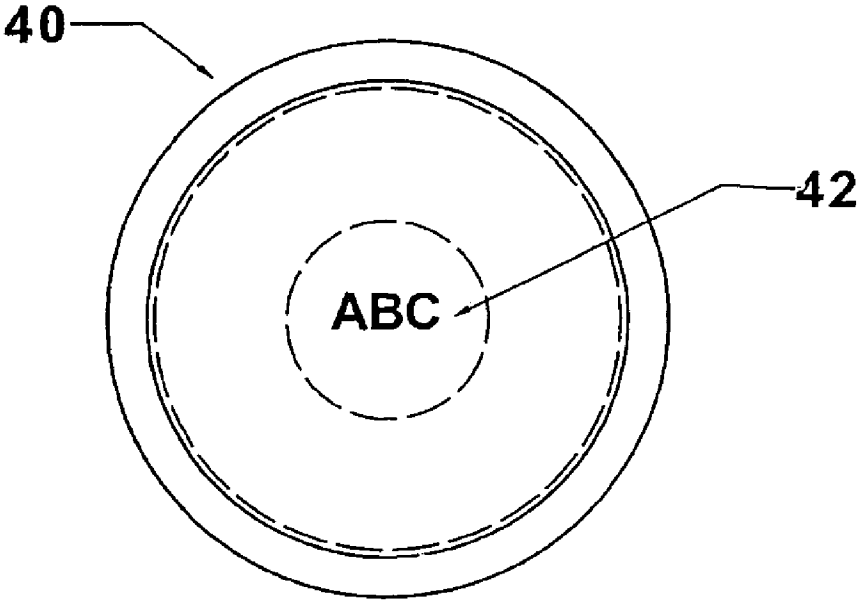
FIGS. 5B-C are plan views of the stamp portion illustrating examples of indicia used on the stamp.
Figure 5B:
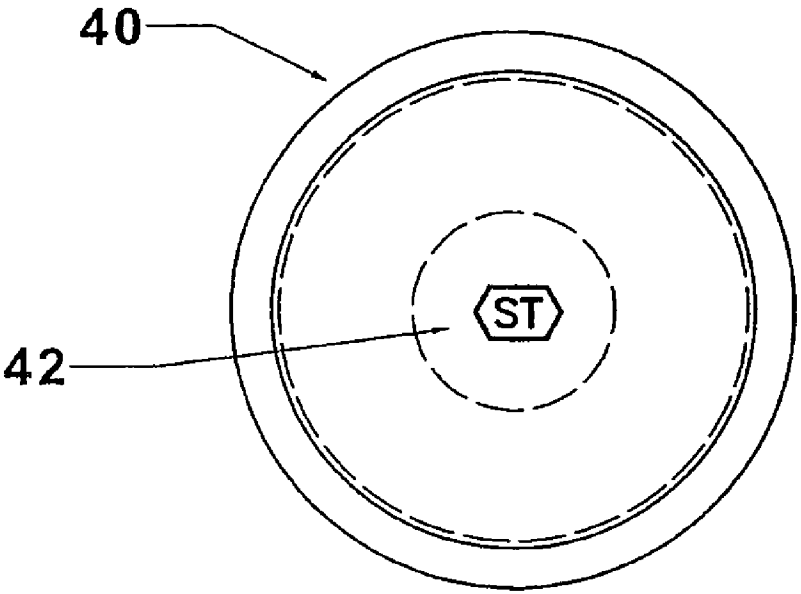

FIGS. 5A-5C provide illustrations of possible stamp surface that may be used. In FIG. 5A, a side view of the stamp portion of the golf ball marker is shown. The stamp portion 30 has a shaped bottom surface 32. This shaped bottom surface 32 may for instance be a concave surface to allow the bottom surface 32 of the stamp portion 30 to more precisely fit the curved surface of a golf ball. The dimensions of the concave surface 32 may thus be such that the size and shape of the concave surface 32 correlate to the size of a golf ball.

FIGS. 5B-5C are plan views of the stamp portion of the golf ball marker. The stamp portion 40 may contain any suitable indicia 42, such as a letter, design, number, or logo. It may be possible, for instance, to include three letters corresponding to the owner's initials. Or, it may be possible to provide a single letter or number on the stamp. The stamp portion 40 may have the indicia 42 permanently attached, or may have the indicia releasably attached so that a user can remove and replace the indicia on the stamp based on user preference. Any suitable manner of releasably attaching the indicia 42 to the stamp portion 40 may be used.

The stamp portion 40 may be any suitable stamp for use with any suitable ink. It may be preferable to provide an ink which is all-weather, to ensure the stamp applied by the stamp portion 30 to a golf ball is sufficiently durable to last a round of golf. The ink may further be a washable ink, so that the mark can be washed off the ball after the round is completed. Lastly, the ink may be sufficiently fast-drying to avoid transferring any ink from the golf ball to the hand of the user.

Further, the ink may be applied to the stamp portion using any suitable, known method. For instance, it may be possible to provide the stamp portion so that it is self inking. Otherwise, it is possible to provide the stamp with a finite amount of ink, assuming that after a certain number of uses, the ink will dry out, and the golf ball marker will be disposed of and replaced.

The golf ball stamp of the present invention is an improvement over prior art devices that are either overly complicated, or do not provide the stability required to ensure a legible stamp is applied to the surface of the golf ball stamp. While other stamps may be overly complicated to use, or may have a stamp area that is so small that when applying the stamp it slips across the golf ball surface leaving a smear rather than a legible stamp, the present invention provides a simple, reliable way to mark a golf ball with a stamp every time.

Although the present invention has been described with reference to preferred embodiments, workers skilled in the art will recognize that changes may be made in form and detail without departing from the spirit and scope of the invention.

The invention claimed is:

1. A golf ball stamper comprising:

a handle;

a stamp element operatively coupled to the handle, the stamp element including a movable stamp portion and a stamp indicia element; and a golf ball receptacle comprising a cylinder having an inner diameter which approximates a diameter of a golf ball and includes an inner ring, the golf ball receptacle connected to the stamping element at the inner ring so that the stamping element contacts the golf ball when the handle is pushed.

2. The golf ball stamper of claim 1 wherein the inner ring is located at a first distance from a top of the golf ball receptacle and a second distance from a bottom of the golf ball receptacle, wherein the second distance is such that a golf ball fits in the golf ball receptacle and abuts against the inner ring.

3. The golf ball stamper of claim 2 wherein the movable stamp portion is sized to be smaller than a diameter of the inner ring so that the movable stamp portion can be moved into the golf ball receptacle when the handle is pushed.

4. The golf ball stamper of claim 3 wherein the first distance is such that when the handle is depressed, the stamp indicia element of the movable stamp portion contacts a surface of the golf ball.

5. The golf ball stamper of claim 1 wherein the stamping element has a curved surface.

6. The golf ball stamper of claim 1 wherein the stamping element comprises a self inking stamp.

7. The golf ball stamper of claim 1 wherein the stamp indicia element is configured to be releasably attached to the stamping element.

8. The golf ball stamper of claim 1 and further comprising indicia on the handle, wherein the indicia on the handle corresponds to the stamp indicia element.

9. A golf ball stamping kit, the kit comprising:

a golf ball stamper having a handle;

a plurality of stamping elements, wherein each stamping element is configured to be operatively coupled to the handle; and a golf ball receptacle sized to hold a golf ball at a lower end and support the handle at an upper end, the golf ball receptacle including an inner ring located between the lower end and the upper end, the golf ball receptacle connected to one of the plurality of stamping elements at the inner ring so that the stamping element contacts the golf ball when the handle is pushed.

10. The golf ball stamping kit of claim 9 wherein the stamping elements comprise a curved surface which corresponds to a surface of a golf ball.

11. The golf ball stamping kit of claim 9 wherein the golf ball receptacle is a cylinder having a diameter approximately equal to that of a golf ball.

12. A method of marking a golf ball, the method comprising:

providing a golf ball stamper comprising a handle, a stamp element operatively coupled to the handle, and a cylindrical golf ball receptacle having an inner diameter which approximates a diameter of a golf ball and includes an inner ring, wherein the golf ball receptacle is connected to the stamp element at the inner ring;

inserting a golf ball into the golf ball receptacle;

maintaining the golf ball in the golf ball receptacle while pressing the handle on the stamping element to stamp the golf ball.

13. The method of marking a golf ball of claim 12 and further comprising:

selecting a stamp element from a plurality of stamp elements; and coupling the selected stamp element to the handle.

* * * * *